US009760054B2

(12) United States Patent
Hanano

(10) Patent No.: US 9,760,054 B2
(45) Date of Patent: Sep. 12, 2017

(54) IMAGE FORMING APPARATUS THAT ENSURES IMPROVED REPLACEMENT WORKABILITY OF IMAGE CARRIER UNIT

(71) Applicant: Kyocera Document Solutions Inc., Osaka (JP)

(72) Inventor: Susumu Hanano, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 15/208,629

(22) Filed: Jul. 13, 2016

(65) Prior Publication Data

US 2017/0017191 A1 Jan. 19, 2017

(30) Foreign Application Priority Data

Jul. 13, 2015 (JP) ..... 2015-139324

(51) Int. Cl.
*G03G 15/00* (2006.01)
*G03G 21/16* (2006.01)
*G03G 21/18* (2006.01)

(52) U.S. Cl.
CPC ..... *G03G 15/75* (2013.01); *G03G 21/1647* (2013.01); *G03G 21/1671* (2013.01); *G03G 21/185* (2013.01); *G03G 2221/1654* (2013.01)

(58) Field of Classification Search
CPC ..... G03G 15/75; G03G 21/1647; G03G 21/1671; G03G 21/185; G03G 2221/1654
USPC ..... 399/113, 116, 117
See application file for complete search history.

(56) References Cited

U.S. PATENT DOCUMENTS

2004/0184835 A1* 9/2004 Park ..... G03G 21/1821 399/116
2005/0220481 A1 10/2005 Yamaguchi et al.

FOREIGN PATENT DOCUMENTS

EP 1431837 A1 6/2004
JP 2008-009295 A 1/2008

* cited by examiner

*Primary Examiner* — Sandra Brase
(74) *Attorney, Agent, or Firm* — James Judge

(57) ABSTRACT

An image forming apparatus includes an image carrier unit, a developing device, and an intermediate transfer body. The image forming apparatus body includes a positioning member having a positioning hole for inserting a positioning pin in a mounting direction and a guiding member including a guide rail portion for guiding the image carrier unit when mounting and removing the image carrier unit. The image carrier unit includes a sliding portion that slides with respect to the guide rail portion. When the image carrier unit is drawn from a mounted state where the image carrier unit is mounted to the image forming apparatus body, the sliding portion is drawn by a predetermined distance in parallel with the rotation shaft direction and then moves in a direction where the image carrier retreats from the developing device and the intermediate transfer body, along the guide rail portion.

4 Claims, 7 Drawing Sheets

IMAGE FORMING APPARATUS THAT ENSURES IMPROVED REPLACEMENT WORKABILITY OF IMAGE CARRIER UNIT

INCORPORATION BY REFERENCE

This application is based upon, and claims the benefit of priority from, corresponding Japanese Patent Application No. 2015-139324 filed in the Japan Patent Office on Jul. 13, 2015, the entire contents of which are incorporated herein by reference.

BACKGROUND

Unless otherwise indicated herein, the description in this section is not prior art to the claims in this application and is not admitted to be prior art by inclusion in this section.

There is provided a typical image forming apparatus that includes: a drum unit (image carrier unit) with a photoreceptor drum (image carrier) onto which an electrostatic latent image is formed; a developing device, which includes a developing roller (developer carrier) supplying toner to the photoreceptor drum, located adjacent to the drum unit; and an intermediate transfer belt (intermediate transfer body) onto which a toner image developed on the photoreceptor drum is transferred.

This type of image forming apparatuses require replacement of a drum unit including a photoreceptor drum when a count of printed sheets reaches a predetermined number of sheets (for example, several tens of thousands of sheets), due to the life of the photoreceptor drum. Sliding the drum unit in a rotation shaft direction of the photoreceptor drum mounts or removes the drum unit with respect to the image forming apparatus body.

There is an image forming apparatus where sliding a drum unit in a rotation shaft direction of a photoreceptor drum mounts or removes the drum unit with respect to the image forming apparatus body.

SUMMARY

An image forming apparatus according to one aspect of the disclosure includes an image carrier unit, a developing device, and an intermediate transfer body. The image carrier unit includes an image carrier on which an electrostatic latent image is formed. The image carrier unit is removably mountable with respect to an image forming apparatus body by sliding in a rotation shaft direction of the image carrier. The developing device includes a developer carrier that supplies the image carrier with toner, the developing device being located adjacent to the image carrier unit. A toner image developed on the image carrier by the developing device is transferred on to the intermediate transfer body. An end portion of the image carrier unit in a mounting direction to the image forming apparatus body includes a positioning pin protruding in the mounting direction. The image forming apparatus body includes a positioning member having a positioning hole for inserting the positioning pin in the mounting direction and a guiding member including a guide rail portion for guiding the image carrier unit when mounting and removing the image carrier unit. The image carrier unit includes a sliding portion that slides with respect to the guide rail portion. When the image carrier unit is extracted from a mounted state where the image carrier unit is mounted to the image forming apparatus body, the sliding portion is drawn by a predetermined distance in parallel with the rotation shaft direction and then moves in a direction where the image carrier retreats from the developer carrier and the intermediate transfer body, along the guide rail portion.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
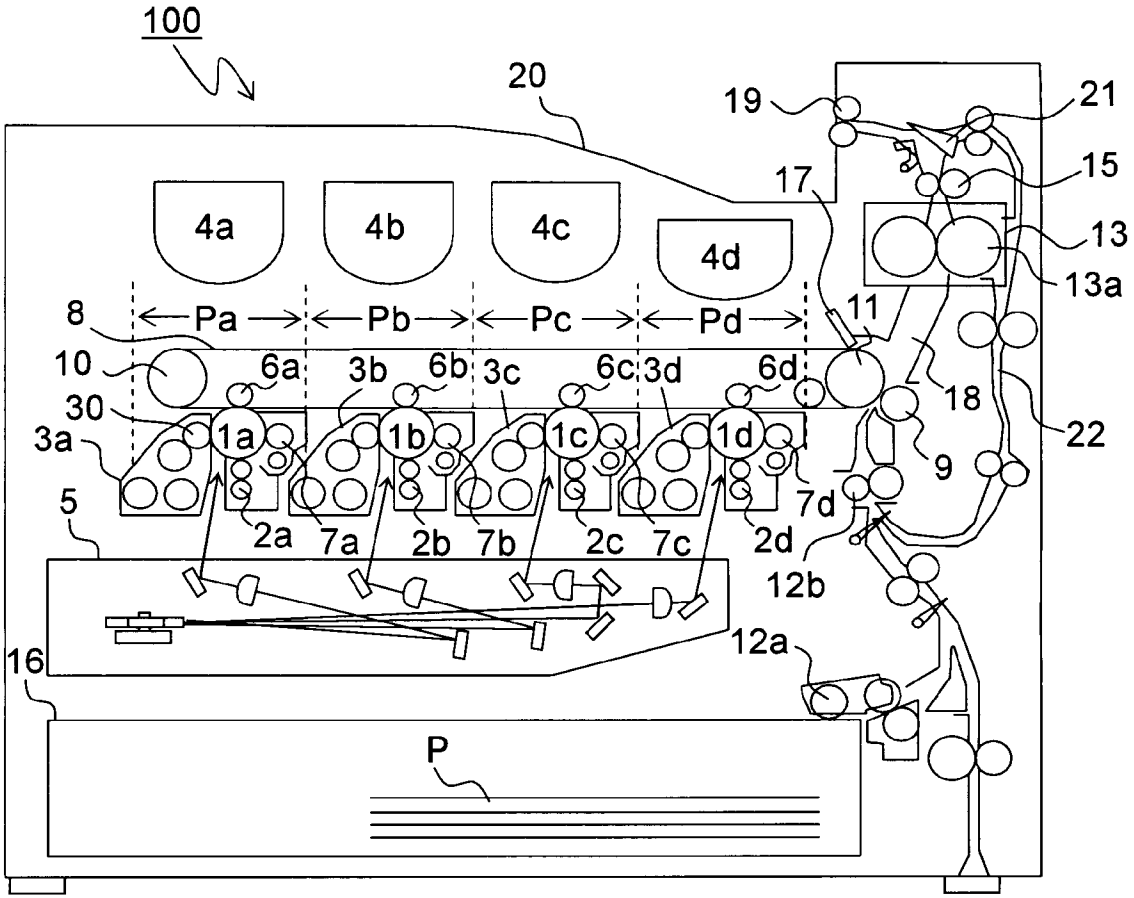
FIG. 1 illustrates a cross section of an overall structure of an image forming apparatus of one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be located, substituted, combined, separated, and designed in a wide variety of different configurations, all of which are explicitly contemplated herein.

The following describes an embodiment of the disclosure with reference to the accompanying drawings.

Referring to FIGS. 1 to 12, a description will be given of an image forming apparatus 100 according to one embodiment of the disclosure.

The image forming apparatus 100 (here, a color printer) is a quadruplicate tandem color printer, which performs image formation with four parallel located photoreceptor drums (image carriers) 1*a*, 1*b*, 1*c*, and 1*d* corresponding to four different colors (yellow, cyan, magenta, and black) in this embodiment.

The image forming apparatus 100 includes four image forming units Pa, Pb, Pc, and Pd in this order from the left side in FIG. 1 in its main body (hereinafter referred to as "apparatus main body"). These image forming units Pa to Pd are located corresponding to images of four different colors (yellow, cyan, magenta, and black), and sequentially form the images of yellow, cyan, magenta, and black through respective processes of charging, exposure, development, and transfer.

These image forming units Pa to Pd include the photoreceptor drums 1*a* to 1*d*, which carry visible images (toner images) of respective colors. Additionally, an intermediate transfer belt (intermediate transfer body) 8, which rotates counterclockwise in FIG. 1, is located adjacent to the respective image forming units Pa to Pd. Toner images formed on these photoreceptor drums 1*a* to 1*d* are sequentially transferred on the intermediate transfer belt 8, which moves in abutting contact with the respective photoreceptor drums 1*a* to 1*d*, and then the toner images are transferred on a paper sheet P as one example of a recording medium at one time by a secondary transfer roller 9. Subsequently, a fixing unit 13 fixes the toner images on the paper sheet P, and then the paper sheet P is discharged from the apparatus main body. The image formation processes to the respective photoreceptor drums 1*a* to 1*d* are performed while rotating the photoreceptor drums 1*a* to 1*d* clockwise in FIG. 1.

The paper sheets P, on which toner images are to be transferred, are housed in a paper sheet cassette 16 located in the lower portion of the apparatus, and are conveyed to the secondary transfer roller 9 via a feed roller 12*a* and a registration roller pair 12*b*. A belt drive motor (not illustrated) rotationally drives the intermediate transfer belt 8 and the secondary transfer roller 9 at a linear velocity identical to a linear velocity of the photoreceptor drums 1*a* to 1*d*. A blade-shaped belt cleaner 17 is located for removing residual toner or similar matter on the surface of the intermediate transfer belt 8, in the downstream side in the rotation direction of the intermediate transfer belt 8 with respect to the secondary transfer roller 9.

Next, the image forming units Pa to Pd will be described. The following devices are located around and below the rotatably located photoreceptor drums 1*a* to 1*d*: charging apparatuses 2*a*, 2*b*, 2*c*, and 2*d*, which respectively charge the photoreceptor drums 1*a* to 1*d*; an exposure unit 5, which respectively performs exposure based on image data for the respective photoreceptor drums 1*a* to 1*d*; developing devices 3*a*, 3*b*, 3*c*, and 3*d*, which respectively develop electrostatic latent images formed on the photoreceptor drums 1*a* to 1*d* by toner; and cleaning apparatuses 7*a*, 7*b*, 7*c* and 7*d*, which respectively recover and remove the developer (toner) remaining on the photoreceptor drums 1*a* to 1*d* after the transfer of the toner image.

When image data is input from a host apparatus such as a personal computer, first, the charging apparatuses 2*a* to 2*d* evenly charge the surfaces of the corresponding photoreceptor drums 1*a* to 1*d*, respectively, and then the exposure unit 5 irradiates the photoreceptor drums 1*a* to 1*d* with light on the basis of the image data to respectively form electrostatic latent images corresponding to the image data on the photoreceptor drums 1*a* to 1*d*. The developing devices 3*a* to 3*d* include developing rollers (developer carrier) 30 located opposed to the photoreceptor drums 1*a* to 1*d* and are filled with predetermined amounts of two-component developers including toners of respective colors of yellow, cyan, magenta, and black, respectively.

When proportions of toners in the two-component developers filled in the respective developing devices 3*a* to 3*d* become less than a specified value due to toner image formation described below, corresponding toner containers 4*a* to 4*d* respectively replenish the developing devices 3*a* to 3*d* with toners. The toners are supplied and electrostatically attached onto the corresponding photoreceptor drums 1*a* to 1*d* by the developing devices 3*a* to 3*d*. This forms the toner images corresponding to the electrostatic latent images formed by the exposure by the exposure unit 5.

Then, primary transfer rollers 6*a* to 6*d* apply electric fields at predetermined transfer voltages between the primary transfer rollers 6*a* to 6*d* and the corresponding photoreceptor drums 1*a* to 1*d*, and the toner images of yellow, cyan, magenta, and black on the photoreceptor drums 1*a* to 1*d* are primarily transferred onto the intermediate transfer belt 8. These four-color images are formed with a predetermined positional relationship for a predetermined full-color image formation. Subsequently, to prepare for new electrostatic latent image formation to be continuously performed, the cleaning apparatuses 7*a* to 7*d* respectively remove the toners remained on the corresponding surfaces of the photoreceptor drums 1*a* to 1*d*.

When the intermediate transfer belt 8, which is extended between a driven roller 10 and a drive roller 11, starts to rotate counterclockwise in association with the rotation of the drive roller 11 by the belt drive motor, the registration roller pair 12*b* conveys the paper sheet P to a nip portion (secondary transfer nip portion), which is formed between the secondary transfer roller 9 located adjacent to the intermediate transfer belt 8 and the intermediate transfer belt 8, at a predetermined timing. This secondarily transfers a full-color image on the paper sheet P at the nip portion. The paper sheet P, on which the toner image has been transferred, is conveyed to the fixing unit 13.

The paper sheet P conveyed to the fixing unit 13 is heated and pressured when passing through a fixing nip portion of a fixing roller pair 13*a* constituted with a heating roller and a pressure roller. This fixes the toner image on the surface of the paper sheet P, and thus forms the predetermined full-color image on the paper sheet P. The paper sheet P, on which the full-color image has been formed, is sorted into a conveyance direction by a branching member 21 located at a branching portion of a paper sheet conveyance passage 18, through a conveyance roller pair 15. Then the paper sheet P is directly (or, after being sent to a duplex conveyance path 22 and undergoing duplex copying) discharged to a discharge tray 20 via a discharge roller pair 19.

The paper sheet conveyance passage 18, specifically, branches into left-and-right directions of fork in the downstream side of the conveyance roller pair 15, and one path (a path branching into the left direction in FIG. 1) is configured to communicate with the discharge tray 20. Then, another path (a path branching into the right direction in FIG. 1) is configured to communicate with the duplex conveyance path 22. When the images are formed on both surfaces of the paper sheet P, a part of the paper sheet P, which has passed through the fixing unit 13, is once protruded up to the outside of the apparatus from the discharge roller pair 19.

Subsequently, reversely rotating the discharge roller pair 19 and approximately horizontally swinging the branching member 21 guide the paper sheet P to the duplex conveyance path 22 along the top surface of the branching member 21 and convey the paper sheet P to the secondary transfer roller 9 again with the image surface inverted. Then, the secondary transfer roller 9 transfers the next image formed on the intermediate transfer belt 8 on the surface, where no image is formed, of the paper sheet P. The paper sheet P is conveyed to the fixing unit 13 and the toner image is fixed on the paper sheet P. Then the paper sheet P is discharged to the discharge tray 20.

Figure 2:
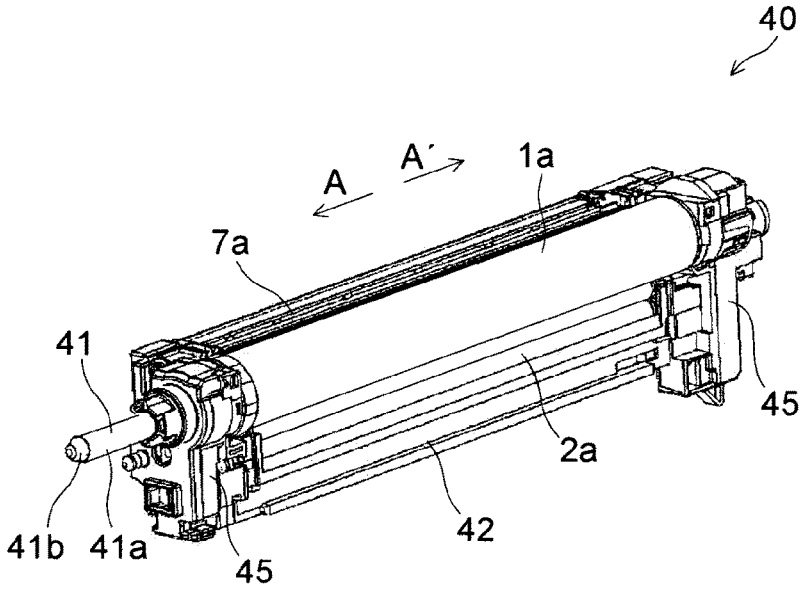
FIG. 2 obliquely illustrates a structure of a drum unit of the image forming apparatus according to the one embodiment.

Next, the following describes the detail peripheral structure of the photoreceptor drum 1*a*. FIG. 2 illustrates a state viewed from the back side of FIG. 1. While the following describes an exemplary peripheral structure of the photoreceptor drum 1*a* located in the image forming unit Pa in FIG. 1, the peripheral structures of the photoreceptor drums 1*b* to 1*d* respectively located in the image forming units Pb to Pd are basically identical. Thus, their description will be omitted.

As illustrated in FIG. 2, the photoreceptor drum 1*a*, the charging apparatus 2*a*, and the cleaning apparatus 7*a*, which are held onto a pair of holding members 45 and thus are integrally formed, constitute a drum unit (image carrier unit) 40. The drum unit 40 is configured to be removably mountable with respect to the apparatus main body by sliding in a rotation shaft direction (a direction in which a rotation shaft 41 extends, an arrow AA' direction) of the photoreceptor drum 1*a*.

The rotation shaft 41 of the photoreceptor drum 1*a* protrudes from an end portion of the drum unit 40 in a mounting direction side (an arrow A direction) to the apparatus main body, toward the mounting direction. This rotation shaft 41 serves as a positioning pin when positioning the drum unit 40 with respect to the apparatus main body.

Figure 3:
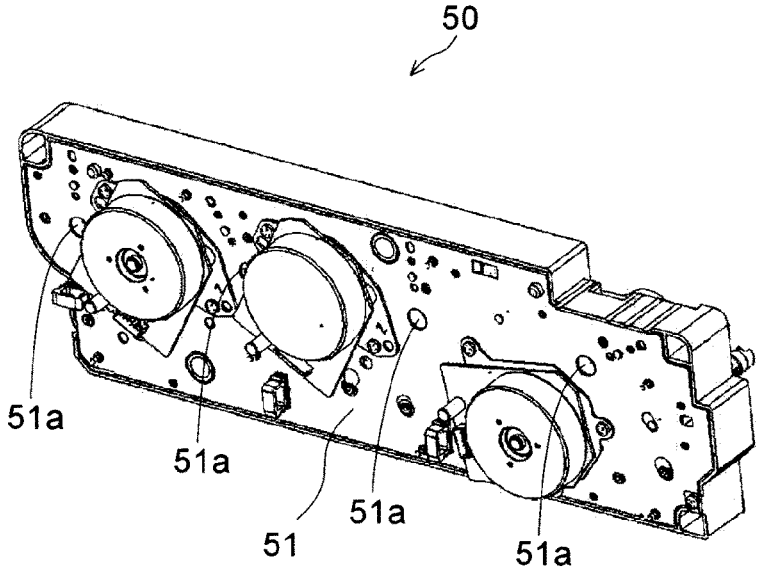
FIG. 3 obliquely illustrates a structure of a positioning member of the image forming apparatus according to the one embodiment.
Figure 4:
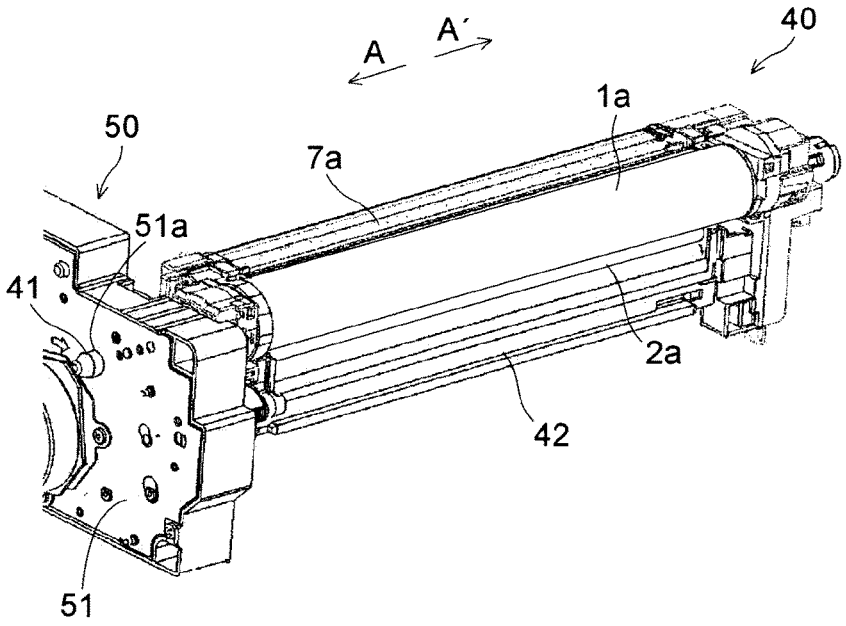
FIG. 4 obliquely illustrates the drum unit, which is mounted to the positioning member, of the image forming apparatus according to the one embodiment.

As illustrated in FIGS. 3 and 4, the apparatus main body includes a positioning member 50 that positions the drum unit 40. The positioning member 50 includes a supporting frame 51 made of sheet metal, to which the drive motor or similar component is mounted. At predetermined positions of the supporting frame 51, positioning holes 51*a*, into which the rotation shaft 41 of each of the drum units 40 is inserted, are formed at a predetermined pitch.

Figure 5:
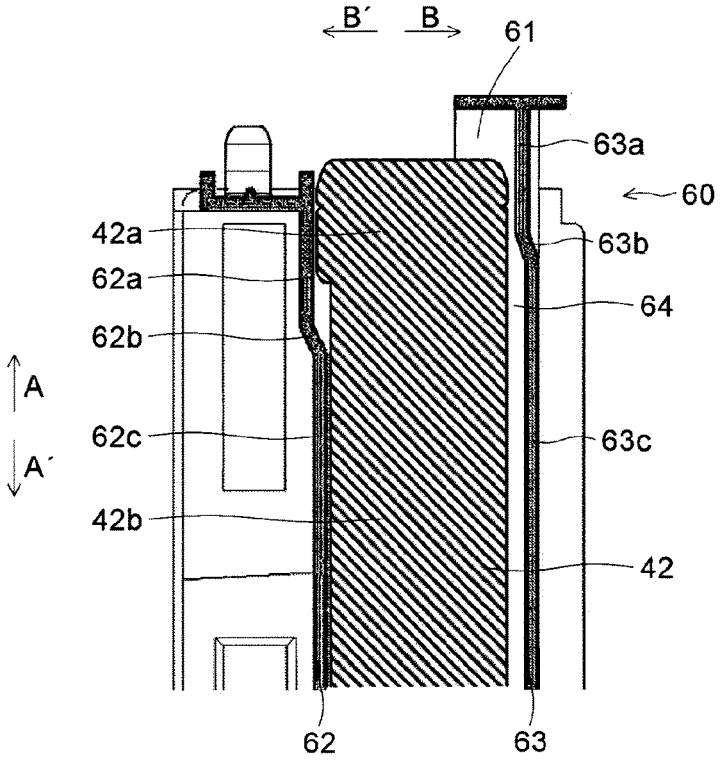
FIG. 5 illustrates a cross section of a structure of a sliding portion and a guide rail portion, from above, in a mounted state of the drum unit of the image forming apparatus according to the one embodiment.

As illustrated in FIG. 5, the apparatus main body includes a guiding member 60 with a guide rail portion 61 guiding the drum unit 40 when the drum unit 40 is mounted or removed with respect to the apparatus main body.

As illustrated in FIG. 2, a sliding portion 42, which slides with respect to the guide rail portion 61 when the drum unit 40 is mounted or removed with respect to the apparatus main body, is formed in the lower portion of the drum unit 40.

Next, the following further describes the structures of the rotation shaft 41 of the drum unit 40, the sliding portion 42, and the guide rail portion 61 in detail.

Figure 6:
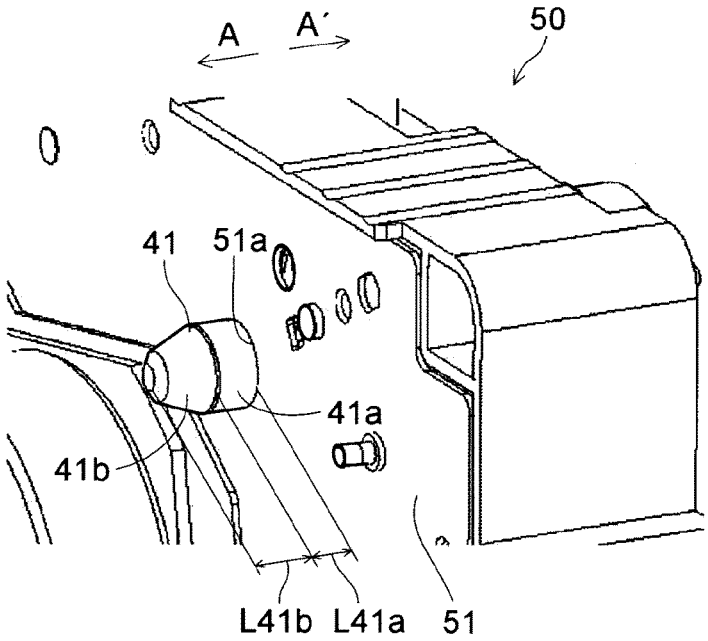
FIG. 6 obliquely illustrates a peripheral structure of a tapered portion of a rotation shaft in the state where the drum unit of the image forming apparatus according to the one embodiment is mounted to the positioning member.

The rotation shaft 41, as illustrated in FIGS. 2 and 6, has a cylindrical portion 41*a* with a constant outer diameter and a tapered portion 41*b* with the outer diameter decreasing from the cylindrical portion 41*a* toward the mounting direction (the arrow A direction). The tapered portion 41*b* and a part of the cylindrical portion 41*a* protrude from the positioning hole 51*a* of the supporting frame 51 to the mounting direction (the arrow A direction) in a mounted state (a state in FIGS. 4 and 5) where the drum unit 40 is mounted to the apparatus main body. Additionally, the tapered portion 41*b* has a pair of inclined surfaces 41*c* (see FIG. 11) in side view.

Figure 7:
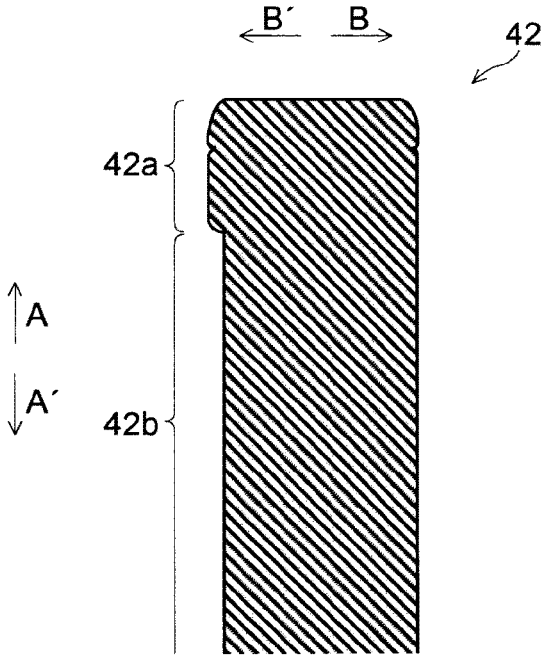
FIG. 7 illustrates a cross section of the structure of the sliding portion of the image forming apparatus according to the one embodiment from above.
Figure 8:
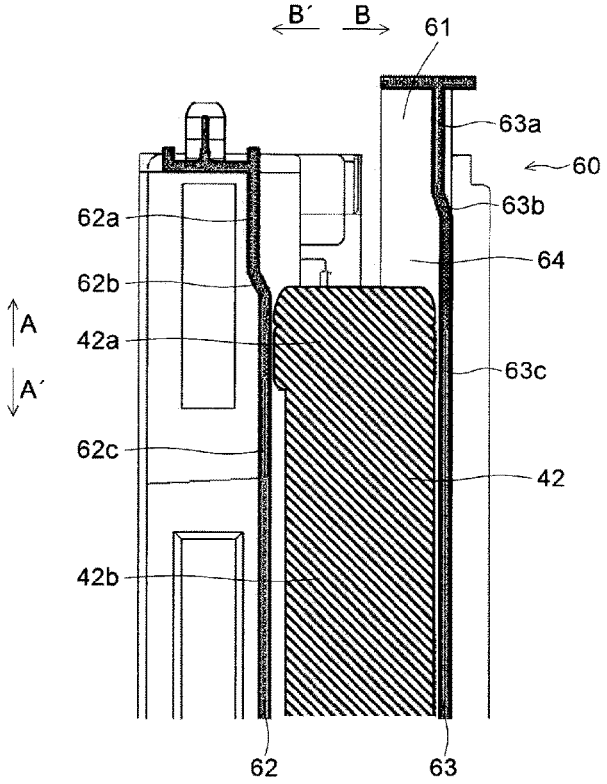
FIG. 8 illustrates a cross section of the structure of the sliding portion and the guide rail portion from above during drawing of the drum unit of the image forming apparatus according to the one embodiment.
Figure 9:
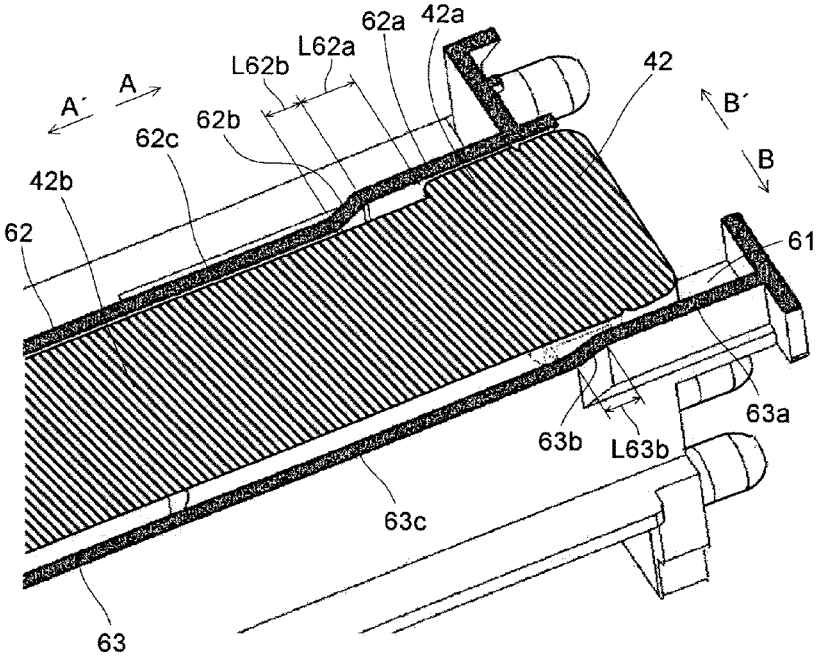
FIG. 9 illustrates a cross section of the structure of the sliding portion and the guide rail portion in the mounted state of the drum unit of the image forming apparatus according to the one embodiment from obliquely above.

The sliding portion 42, as illustrated in FIGS. 5 and 7, is formed to extend in a mounting/removing direction (the arrow AA' direction) of the drum unit 40 and includes a distal end portion 42*a* located at the end portion in the mounting direction (the arrow A direction) and a center portion 42*b* located in the opposite direction (the arrow A' direction) to the mounting direction with respect to the distal end portion 42*a*.

A length in a width direction (a direction perpendicular to the arrow AA' direction, an arrow BB' direction) of the distal end portion 42*a* is formed to be a little shorter than a length in the width direction of an internal space of the guide rail portion 61. A length in the width direction of the center portion 42*b* is formed to be further shorter than the length in the width direction of the distal end portion 42*a*. A side surface of the center portion 42*b*, which is an opposite side (an arrow B direction) to the developing device 3*a*, is formed not to protrude (here, on a flush surface) in the arrow B direction with respect a side surface of the distal end portion 42*a*, which is the opposite side (the arrow B direction) to the developing device 3*a*.

The guide rail portion 61 is formed to extend in the mounting/removing direction (the arrow AA' direction) of the drum unit 40, and has a side surface (one side surface) 62 and a side surface (the other side surface) 63, which sandwich the sliding portion 42 in the width direction, and a bottom surface 64 located under the sliding portion 42.

The side surface 62 includes a first straight portion 62*a*, a first inclined portion 62*b*, and a third straight portion 62*c*. The first straight portion 62*a* is located at the end portion in the mounting direction (the arrow A direction) and also extends in parallel with the rotation shaft direction (the arrow AA' direction). The first inclined portion 62*b* extends in the direction intersecting with the first straight portion 62*a* from the first straight portion 62*a* so as to move away from the developing device 3*a*. The third straight portion 62*c* extends in parallel with rotation shaft direction (the arrow AA' direction) from the first inclined portion 62*b* toward a drawing direction (an arrow A' direction). The first straight portion 62*a* is located opposed to the distal end portion 42*a* of the sliding portion 42 when the drum unit 40 is in the mounted state (the state in FIG. 5).

A distance L62*a* (see FIG. 9), by which the distal end portion 42*a* of the sliding portion 42 moves in the rotation shaft direction (the arrow AA' direction) along the first straight portion 62*a* when the drum unit 40 is drawn from the mounted state, is formed to be an approximately identical size as a length L41*a* (see FIG. 6), which is a portion of the cylindrical portion 41*a* of the rotation shaft 41 protruded from the positioning hole 51*a*. Further, a length L62*b* (see FIG. 9) of the first inclined portion 62*b* in the rotation shaft direction (the arrow AA' direction) is formed to have the approximately identical size as a length L41*b* (see FIG. 6) of the tapered portion 41*b* of the rotation shaft 41 in the rotation shaft direction (the arrow AA' direction). Furthermore, an inclination angle of the first inclined portion 62*b* relative to the first straight portion 62*a* is formed to have the approximately identical size as an inclination angle of the inclined surface 41*c* of the tapered portion 41*b* of the rotation shaft 41 relative to the cylindrical portion 41*a*.

In view of this, drawing the drum unit 40 from the mounted state draws the sliding portion 42 by a predetermined distance (the distance L62*a*) in parallel with the rotation shaft direction (the arrow AA' direction) along the first straight portion 62*a* and a second straight portion 63*a*, which will be described later, and draws the rotation shaft 41 by the identical distance (the length L41*a*) from the positioning hole 51*a* in parallel with the rotation shaft direction (the arrow AA' direction). Subsequently, the sliding portion 42 moves in a direction (a lower-right oblique direction in FIG. 5) where the photoreceptor drum 1*a* retreats from the developing roller 30, along the first inclined portion 62*b* of the guide rail portion 61 and a second inclined portion 63*b*, which will be described later.

Figure 10:
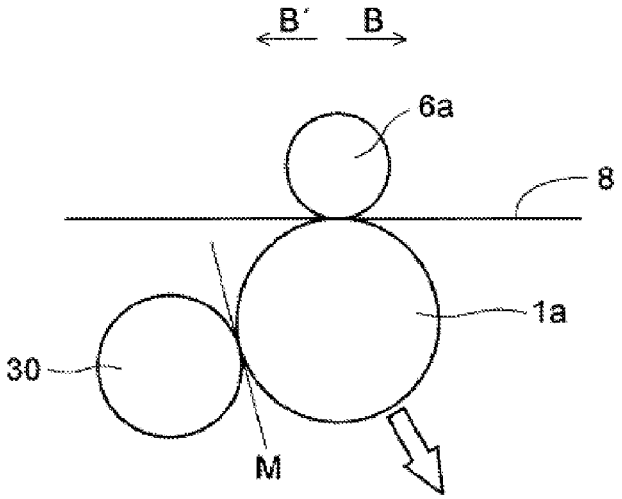
FIG. 10 illustrates a peripheral structure of the photoreceptor drum of the image forming apparatus according to the one embodiment from a drawing direction.

The sliding portion 42 and the bottom surface 64 of the guide rail portion 61 forms a clearance in the mounted state (the state in FIG. 5) of the drum unit 40. In view of this, drawing the drum unit 40 from the mounted state draws the sliding portion 42 by the predetermined distance (the distance L62*a*) and then moves the sliding portion 42 downward by the clearance between the sliding portion 42 and the bottom surface 64 of the guide rail portion 61. That is, the sliding portion 42 is drawn by the predetermined distance (the distance L62*a*) and then moves in the direction (the lower-right oblique direction in FIG. 10) where, as illustrated in FIG. 10, the photoreceptor drum 1*a* retreats from the developing roller 30 and the intermediate transfer belt 8. The center position of the developing roller 30 is located lower than that of the photoreceptor drum 1*a*, and thus a tangent line M of the developing roller 30 and the photoreceptor drum 1*a* is inclined. The photoreceptor drum 1*a* moves in a direction where the photoreceptor drum 1*a* moves away from the tangent line M.

Subsequently, the sliding portion 42 is drawn in parallel with the rotation shaft direction (the arrow AA' direction) along the third straight portion 62*c* of the guide rail portion 61 and a fourth straight portion 63*c*, which will be described later.

The side surface 63, as illustrated in FIG. 5, includes the second straight portion 63*a*, the second inclined portion 63*b*, and the fourth straight portion 63*c*. The second straight portion 63*a* is located at the end portion in the mounting direction (the arrow A direction) and also extends in parallel with the rotation shaft direction (the arrow AA' direction). The second inclined portion 63*b* is located in the mounting direction side (the arrow A direction) with respect to the first inclined portion 62*b* and also extends from the second straight portion 63*a* in parallel with the first inclined portion 62*b*. The fourth straight portion 63*c* extends in parallel with the rotation shaft direction (the arrow AA' direction) from the second inclined portion 63*b* toward the drawing direction (the arrow A' direction). The second straight portion 63*a* is located opposed to the distal end portion 42*a* of the sliding portion 42 in the mounted state (the state in FIG. 5) of the drum unit 40.

A length L63*b* (see FIG. 9) of the second inclined portion 63*b* in the rotation shaft direction (the arrow AA' direction) has the approximately identical size as the length L62*b* (see FIG. 9) of the first inclined portion 62*b* in the rotation shaft direction (the arrow AA' direction).

In view of this, mounting the drum unit 40 to the apparatus main body moves the sliding portion 42 in the mounting direction (the arrow A direction) in parallel with the rotation shaft direction (the arrow AA' direction) along the fourth straight portion 63*c* and the third straight portion 62*c*. Subsequently, the sliding portion 42 moves in a direction (an upper-left oblique direction in FIG. 5) where the photoreceptor drum 1*a* approaches the developing roller 30, along the second inclined portion 63*b* and the first inclined portion 62*b*.

Figure 11:
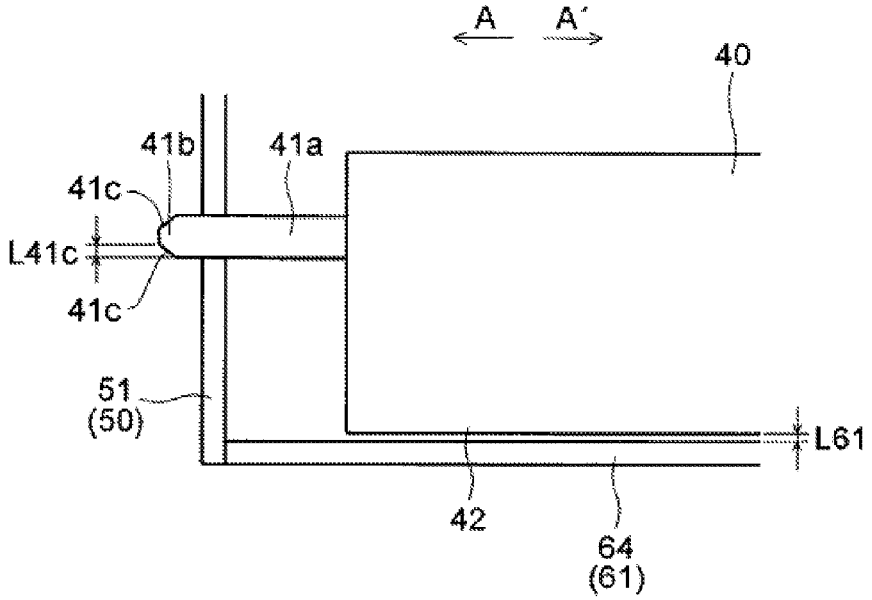
FIG. 11 illustrates the drum unit, which is mounted to the apparatus main body, of the image forming apparatus according to the one embodiment.
Figure 12:
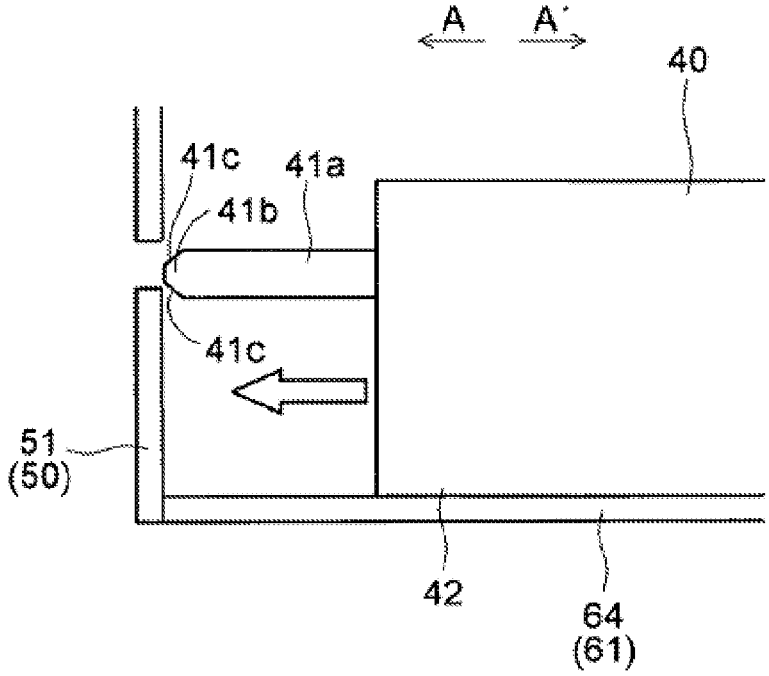
FIG. 12 illustrates a state where the drum unit of the image forming apparatus according to the one embodiment is being mounted to the apparatus main body.

As illustrated in FIG. 11, the bottom surface 64 of the guide rail portion 61 is a flat surface, and, as described above, the sliding portion 42 and the bottom surface 64 of the guide rail portion 61 form the clearance in the mounted state (the state in FIG. 11) of the drum unit 40. Assume that this clearance has a length of L61. A length L41*c* of one of the inclined surface 41*c* of the tapered portion 41*b* in the vertical direction is formed to be larger than the length L61. In view of this, as illustrated in FIG. 12, mounting the drum unit 40 to the apparatus main body moves the sliding portion 42 in the mounting direction (the arrow A direction) with the sliding portion 42 contacting the bottom surface 64 of the guide rail portion 61, and then lifts the rotation shaft 41 and the sliding portion 42 by the inclined surface 41*c* running upon the peripheral edge portion of the positioning hole 51*a*. That is, the sliding portion 42 is inserted along the third straight portion 62*c*, the fourth straight portion 63*c*, and the bottom surface 64, and then moves in the direction (the upper-left oblique direction in FIG. 10) where the photoreceptor drum 1*a* approaches the developing roller 30 and the intermediate transfer belt 8, in reverse with respect to the time of drawing.

Subsequently, the sliding portion 42 is inserted by the predetermined distance (the distance L62*a*) in parallel with the rotation shaft direction (the arrow AA' direction) along the second straight portion 63*a* and the first straight portion 62*a*, and the rotation shaft 41 is inserted into the positioning hole 51*a* by the identical distance (the length L41*a*) in parallel with the rotation shaft direction (the arrow AA' direction). Consequently, the drum unit 40 is mounted to the apparatus main body.

In the embodiment, as described above, drawing the drum unit 40 from the mounted state, where the drum unit 40 is mounted to the apparatus main body, draws the sliding portion 42 by the predetermined distance in parallel with the rotation shaft direction (the arrow AA' direction), and then moves the sliding portion 42 in the direction where the photoreceptor drums 1*a* to 1*d* retreat from the developing rollers 30 and the intermediate transfer belt 8 along the guide rail portion 61. This ensures avoiding the drum unit 40 from contacting the developing roller 30 and the intermediate transfer belt 8 when the drum unit 40 is extracted from the apparatus main body. Consequently, this ensures prevention of damage on the surfaces of the photoreceptor drums 1*a* to 1*d*, the developing rollers 30, or the intermediate transfer belt 8.

Locating the guide rail portion 61, which guides the sliding portion 42 of the drum unit 40, automatically retreats the photoreceptor drums 1*a* to 1*d* from the developing rollers 30 and the intermediate transfer belt 8, simply by an operator's sliding drum unit 40 in the rotation shaft direction (the arrow AA' direction) of the photoreceptor drums 1*a* to 1*d*. This ensures prevention of reduction of replacement workability of the drum unit 40.

In the cylindrical portion 41*a*, as described above, the length L41*a* of the portion that is protruded from the positioning hole 51*a* is formed to have the approximately identical size as the distance L62*a*, by which the sliding portion 42 moves in the rotation shaft direction (the arrow AA' direction) along the first straight portion 62*a* when the drum unit 40 is drawn from the mounted state. Further, the length L41*b* of the tapered portion 41*b* in the rotation shaft direction and the inclination angle of the tapered portion 41*b* relative to the cylindrical portion 41*a* are formed to have the approximately identical as the length L62*b* of the first inclined portion 62*b* in the rotation shaft direction and the inclination angle of the first inclined portion 62*b* relative to the first straight portion 62*a*, respectively. This ensures that the rotation shaft 41 and the sliding portion 42 moves in parallel with the rotation shaft direction until the drum unit 40 is extracted by the predetermined distance (the length L41*a*, the distance L62*a*) from the mounted state. Subsequently, the tapered portion 41*b* of the rotation shaft 41 moves along the positioning hole 51*a*, and the sliding portion 42 moves along the first inclined portion 62*b*. Consequently, the photoreceptor drums 1*a* to 1*d* move in the direction where the photoreceptor drums 1*a* to 1*d* retreat from the developing rollers 30 and the intermediate transfer belt 8. This easily ensures preventing the drum unit 40 from contacting the developing roller 30 and the intermediate transfer belt 8 when the drum unit 40 is drawn from the apparatus main body.

Further, the relatively short stroke (the length L41*a*+L41*b*) ensures retreating of the photoreceptor drums 1*a* to 1*d* from the developing rollers 30 and the intermediate transfer belt 8.

Further, as described above, the length L63*b* of the second inclined portion 63*b* of the guide rail portion 61 in the rotation shaft direction (the arrow AA' direction) is formed to have the approximately identical size as the length L62*b* of the first inclined portion 62*b* in the rotation shaft direction. This ensures easy mounting of the drum unit 40 to the apparatus main body when mounting the drum unit 40 to the apparatus main body because the sliding portion 42 moves reversely an identical path as the path at the time of the drawing.

Additionally, as described above, the length L41*c* of one of the inclined surface 41*c* of the tapered portion 41*b* in the vertical direction is larger than the length L61 between the sliding portion 42 and the bottom surface 64 of the guide rail portion 61 in the mounted state. This ensures that mounting the drum unit 40 to the apparatus main body moves the sliding portion 42 in the mounting direction with the sliding portion 42 contacting the bottom surface 64 of the guide rail portion 61, and then lifts the rotation shaft 41 and the sliding portion 42 by the inclined surface 41*c* running upon the peripheral edge portion of the positioning hole 51*a*. This ensures easy mounting of the drum unit 40 to the apparatus main body even when the bottom surface 64 of the guide rail portion 61 is a flat surface.

It should be understood that the embodiment disclosed herein is exemplary in all aspects and is not restrictive. The range of the disclosure is indicated not by the description of the embodiment described above but by the claims, and further includes all modifications that has equivalent meaning with the claims and is within the range of the claims.

For example, the disclosure has been exemplified in the application to the color printer; however, the disclosure is not limited to this. It is needless to say that the disclosure is applicable to various kinds of image forming apparatuses that include image carrier units, such as a monochrome printer, a color copier, a monochrome copier, a digital multi-functional peripheral, and a facsimile.

The embodiment has exemplified a flat surface for the bottom surface 64 of the guide rail portion 61; however, the disclosure is not limited to this. For example, the bottom surface 64 may be formed to be an inclined surface for lifting the sliding portion 42 upward at the time of mounting the drum unit 40.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus comprising:

an image carrier unit including an image carrier on which an electrostatic latent image is formed, the image carrier unit being removably mountable with respect to an image forming apparatus body by sliding in a rotation shaft direction of the image carrier;

a developing device including a developer carrier that is configured to supply the image carrier with toner, the developing device being located adjacent to the image carrier unit; and an intermediate transfer body onto which a toner image developed on the image carrier by the developing device is transferred; wherein an end portion of the image carrier unit in a mounting direction to the image forming apparatus body includes a positioning pin protruding in the mounting direction, the image forming apparatus body includes a positioning member having a positioning hole for inserting the positioning pin in the mounting direction and a guiding member including a guide rail portion for guiding the image carrier unit when mounting and removing the image carrier unit, the image carrier unit includes a sliding portion that slides with respect to the guide rail portion, the guide rail portion includes a first straight portion and a first inclined portion, the first straight portion being located opposed to a distal end portion of the sliding portion in the mounting direction in the mounted state and extending in parallel with the rotation shaft direction, the first inclined portion having a predetermined inclination angle relative to the first straight portion and extending from the first straight portion in a direction where the image carrier retreats from the developer carrier, and when the image carrier unit is drawn from a mounted state where the image carrier unit is mounted to the image forming apparatus body, the sliding portion is drawn by a predetermined distance along the first straight portion and then moves along the first inclined portion such that the sliding portion moves in a direction where the image carrier retreats from the developer carrier and the intermediate transfer body.

2. An image forming apparatus comprising:

an image carrier unit including an image carrier on which an electrostatic latent image is formed, the image carrier unit being removably mountable with respect to an image forming apparatus body by sliding in a rotation shaft direction of the image carrier;

a developing device including a developer carrier that is configured to supply the image carrier with toner, the developing device being located adjacent to the image carrier unit and an intermediate transfer body onto which a toner image developed on the image carrier by the developing device is transferred; wherein an end portion of the image carrier unit in a mounting direction to the image forming apparatus body includes a positioning pin protruding in the mounting direction, the positioning pin including a cylindrical portion with a constant outer diameter and a tapered portion where the outer diameter decreases from the cylindrical portion toward the mounting direction;

the image forming apparatus body includes a positioning member having a positioning hole for inserting the positioning pin in the mounting direction and a guiding member including a guide rail portion for guiding the image carrier unit when mounting and removing the image carrier unit the image carrier unit includes a sliding portion that slides with respect to the guide rail portion;

the guide rail portion includes a first straight portion and a first inclined portion, the first straight portion being located opposed to a distal end portion of the sliding portion in the mounting direction in the mounted state and extending in parallel with the rotation shaft direction, the first inclined portion extending from the first straight portion in a direction where the image carrier retreats from the developer carrier;

when the image carrier unit is drawn from a mounted state where the image carrier unit is mounted to the image forming apparatus body, the sliding portion is drawn by a predetermined distance along the first straight portion and then moves along the guide rail portion such that the sliding portion moves in a direction where the image carrier retreats from the developer carrier and the intermediate transfer body;

the predetermined distance has a substantially identical size as a length of a portion of the cylindrical portion, the portion being protruded from the positioning hole, and as a distance that the sliding portion moves in the rotation shaft direction along the first straight portion when the image carrier unit is drawn from the mounted state; and the tapered portion has a length in the rotation shaft direction and an inclination angle relative to the cylindrical portion, the length and the inclination angle respectively having substantially identical sizes as a length of the first inclined portion in the rotation shaft direction, and as an inclination angle of the first inclined portion relative to the first straight portion.

3. The image forming apparatus according to claim 2, wherein:

the first straight portion and the first inclined portion constitute a part of one side surface of the guide rail portion;

the guide rail portion has another side surface having a second straight portion and a second inclined portion, the second straight portion being located opposed to the distal end portion of the sliding portion in the mounted state and extending in parallel with the first straight portion, the second inclined portion being located in the mounting direction with respect to the first inclined portion and extending in parallel with the first inclined portion from the second straight portion; and the second inclined portion has a length in the rotation shaft direction, the length having a substantially identical size as a length of the first inclined portion in the rotation shaft direction.

4. The image forming apparatus according to claim 2, wherein:

the first straight portion and the first inclined portion constitute a part of the side surface of the guide rail portion;

the tapered portion has a pair of inclined surfaces in side view; and one of the inclined surfaces has a length in a vertical direction, the length being larger than a distance between the sliding portion and the bottom surface of the guide rail portion in the mounted state.

* * * * *